US006059449A

United States Patent [19]

Davis et al.

[11] Patent Number: 6,059,449

[45] **Date of Patent: *May 9, 2000**

[54] ROTATABLE MIXING HEAD WITH SEALED BEARINGS

[75] Inventors: Steven W. Davis, Lancaster; Brian T. Gibbs, Hurst; Frank Rosner, Roanoke, all of Tex.

[73] Assignee: Ultimate Environmental Mixing, Inc., Lancaster, Tex.

[ * ] Notice: This patent is subject to a terminal disclaimer.

[21] Appl. No.: 09/129,330

[22] Filed: Aug. 5, 1998

[51] Int. Cl.[7] ..... B01F 7/18

[52] U.S. Cl. ..... 366/325.2; 366/325.3; 366/326.1; 366/331

[58] Field of Search ..... 366/64–66, 96–98, 366/102–104, 262–265, 270, 279, 325.1, 325.2, 325.3, 326.1, 331, 342, 343

[56] References Cited

U.S. PATENT DOCUMENTS

| | | | |
|---|---|---|---|
| 2,515,555 | 7/1950 | Gratias . | |
| 3,038,643 | 6/1962 | Van Der Lely et al. . | |
| 3,650,510 | 3/1972 | Ansel . | |
| 3,887,166 | 6/1975 | Van Ginneken . | |
| 3,986,705 | 10/1976 | Nauta . | |
| 4,162,102 | 7/1979 | Rooymans . | |
| 4,441,824 | 4/1984 | Brokaw . | |
| 4,810,099 | 3/1989 | Langsetmo et al. . | |
| 5,013,185 | 5/1991 | Taki . | |
| 5,212,892 | 5/1993 | Maitlen et al. . | |
| 5,435,176 | 7/1995 | Manchak, III . | |
| 5,556,196 | 9/1996 | Lin . | |
| 5,631,160 | 5/1997 | Bruso . | |
| 5,639,182 | 6/1997 | Paris . | |
| 5,656,041 | 8/1997 | Hylton . | |
| 5,836,690 | 11/1998 | Davis et al. | 366/325.2 |

*Primary Examiner*—Charles E. Cooley
*Attorney, Agent, or Firm*—John A. Thomas

[57] ABSTRACT

A rotatable mixing head assembly attachable to a boom of an excavating machine comprising a torque tube supporting a motor mounted within the torque tube, and a mounting assembly for attaching the rotatable mixing head assembly to the boom of an excavating machine. The device has a rotatable mixing head supported by a drive shaft and driven by the motor, which mixing head supports mixing arms and other implements. The rotating casing of the mixing head defines a cavity. Grease is forced through the cavity and out a seal engaging the casing, thus keeping contaminants from the bearings. A water spray may be provided for suppressing dust. A header is provided for delivering dry or liquid reagents to the mixing site.

21 Claims, 4 Drawing Sheets

( VIEW 3-3 )

ROTATABLE MIXING HEAD WITH SEALED BEARINGS

BACKGROUND

This invention relates to mixing heads used in the environmental remediation industry for mixing and agitating waste or sludge. At most hazardous waste sites, contaminated soil, chemicals, and trash are held in a containment pond. This waste must be thoroughly mixed with reagents or cement to render it either harmless or less likely to migrate to water-bearing strata. Operators have used excavating machinery such as bucket loaders to do this mixing. However, specially adapted mixers are much more efficient. In the present state of the art, such mixers use augers, belts having cutting teeth, or horizontally-rotating mixing heads. Ideally, the operator of the mixing machinery should be able to move the mixing head over the area to be mixed while also controlling its depth and the speed of the mixing. This can be difficult to do with current mixing heads which rotate along an axis substantially horizontal to the surface of the earth. Because of their relatively large surface area to weight ratio, horizontal mixing heads are not easily forced deep into waste ponds, and they tend to become stuck under heavy overburden. Further, horizontally rotating mixing heads are easily tangled in the scrap and wire often found in waste sites. Other mixing machines use augers, but augers also become tangled in scrap and have poor mixing abilities. A mixing head must operate in a hostile environment. It is likely the wastes to be mixed will be dense, contain corrosive chemicals, large heavy objects which can break mixing arms, and also fine abrasive particles which can quickly wear out mixing arms and bearings. The prior-art horizontal mixing heads have unprotected shafts and seals which are particularly susceptible to this kind of wear. Prior-art mixing machines are further susceptible to rapid wear and failure because they do not incorporate the combination of protected thrust bearings and radial bearings of the present invention.

There is thus a need for a mixing head having sufficient power to mix heavy material, easily moveable both laterally and vertically, and resistant to tangling or impact with heavy objects. Such a mixing head should also resist the effects of corrosive and abrasive material in the mixing site. One embodiment of a mixing head having the desired characteristics is described in our U.S. patent application, filed Dec. 17, 1997, which is issued as U.S. Pat. No. 5,836,690, which application is incorporated by reference in to this present application.

SUMMARY

The present invention meets all of these needs. A rotatable mixing head assembly attachable to a boom of an excavating machine comprises a torque tube having an axis, a first end and a second end. The torque tube further comprises a hydraulic motor mounted within the torque tube adjacent to the first end of the torque tube; the hydraulic motor connected to a gear box; the gear box having an output shaft; the hydraulic motor and gear box axially aligned with the axis of the torque tube.

A mounting assembly is attached to the second end of the torque tube for removably attaching the rotatable mixing head assembly to the boom of an excavating machine, and a plurality of implement attachment points are connected to the torque tube.

The preferred embodiment further comprises a rotatable mixing head, which itself comprises a casing axially aligned with and enclosing the first end of the torque tube; the casing externally having a plurality of sockets for receiving a plurality of mixing arms.

The output shaft of the gear box is connected to the casing, so that the casing rotates about the first end of the torque tube. The output shaft, the casing and the first end of the torque tube define a cavity. A means for sealing the bearing housing from the external environment is provided; this sealing means further comprises a resilient cap attached to the first end of the torque tube and sealingly engaging the casing, and a means for delivering lubricant under pressure to the cavity defined by the casing, thereby causing the lubricant to be extruded from the cavity where the casing engages the resilient cap. At least one wear ring is mounted co-axially between the first end of the torque tube and the casing.

A plurality of mixing arms is removably attached to the sockets. The sockets and the mixing arms are disposed about the rotatable mixing head in at least one helical row; and, a means is provided for attaching an implement to the rotatable mixing head.

DRAWINGS

DETAILED DESCRIPTION

Figure 1:
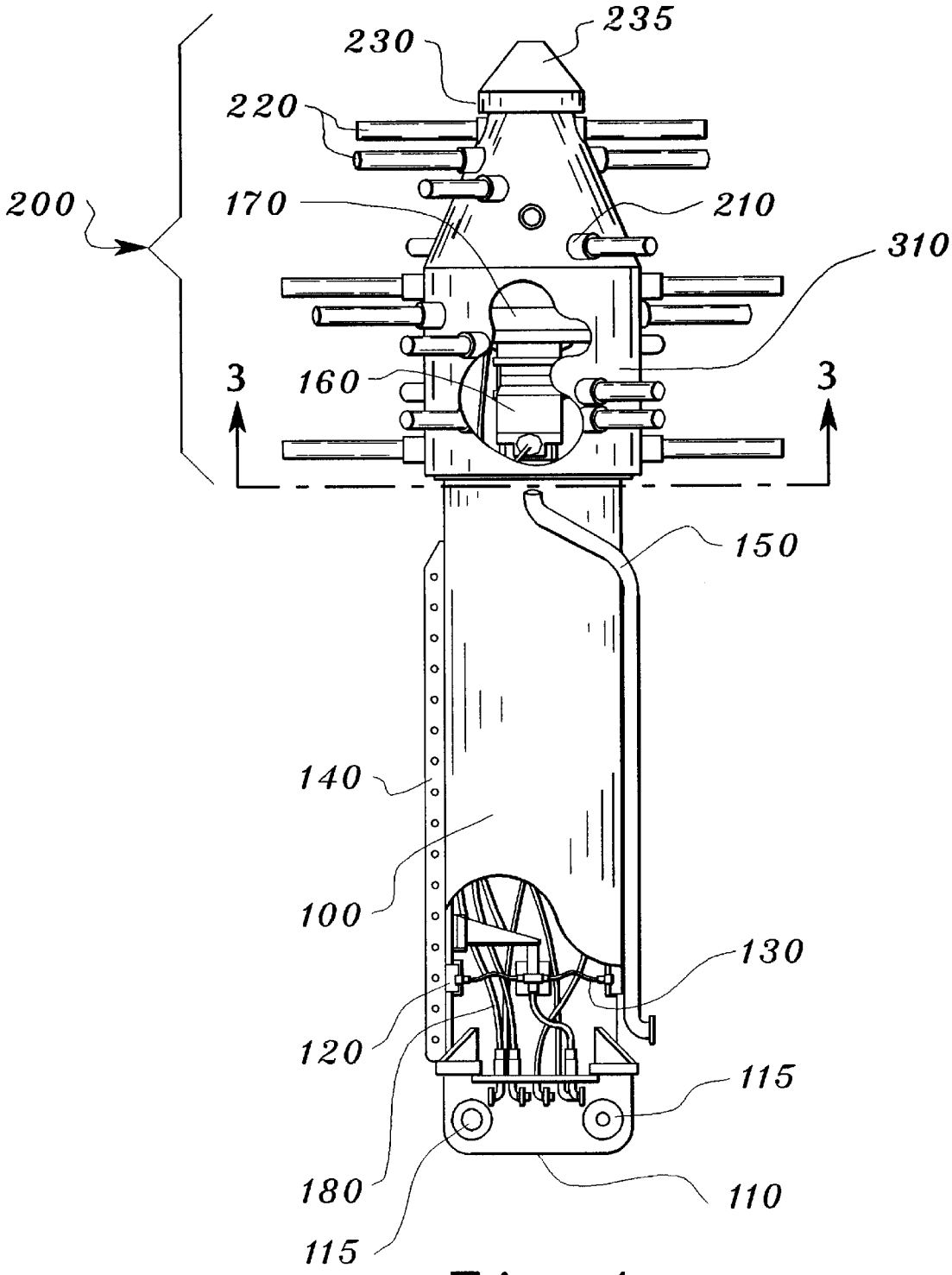
FIG. 1 shows the rotatable mixing head assembly of the preferred embodiment, with a cut-away section of the torque tube revealing a hydraulic motor and fluid supply lines.
Figure 2:
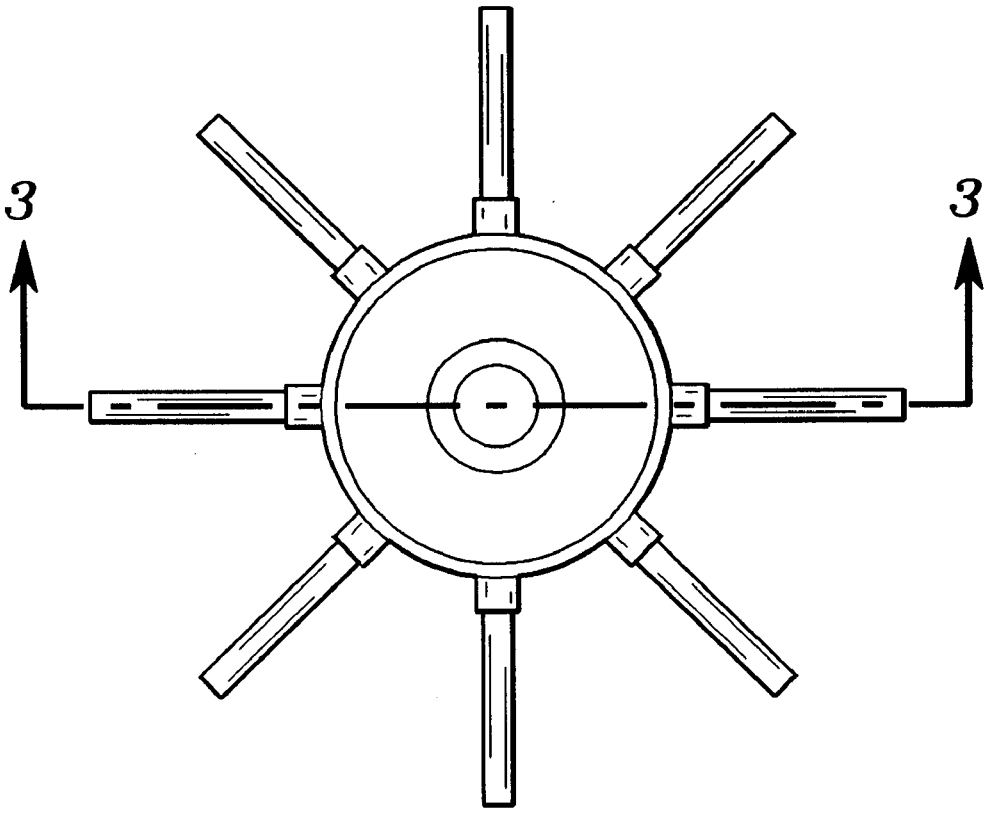
FIG. 2 shows a cross section of the rotatable mixing head assembly, looking toward the rotatable mixing head, to orient the cross-section line of FIG. 3.

FIG. 1 shows the complete rotatable mixing head assembly of the preferred embodiment. The assembly comprises a torque tube 100, a mounting assembly 110, for mounting the rotatable mixing head assembly to the boom of an excavating machine, and a rotatable mixing head 200. The torque tube 100 supports the rotatable mixing head 200 and protects the motor 160 and a group of fluid lines 180 housed within the torque tube 100. The torque tube 100 is made to a length suitable for the mixing task likely to be encountered. A longer torque tube 100, for example, allows the rotatable mixing head assembly to be thrust into deeper containment ponds to achieve thorough mixing. The torque tube 100 contains the means for providing rotary power to the rotatable mixing head 200. In the preferred embodiment, this means is a high-torque, low-speed hydraulic motor 160. If required for additional torque, the hydraulic motor 160 may drive a reduction gear box 170. However, rotary power may also be provided by an electric motor, by electric or hydraulic motors with or without gear boxes, or by flexible couplings transmitting power from engines mounted on the excavating machine. In the preferred embodiment, the direction of rotation of the mixing head 200 may be selectively reversed by the operator. This feature allows the rotatable mixing head assembly to dig out of material blocking its progress or untangle itself from wire or cable.

The mounting assembly 110 of the preferred embodiment is adapted to connect to the conventional mounts of excavating machinery. Such a conventional mount has flanges with holes through which a locking pin is inserted. The mounting assembly 110 of the preferred embodiment has corresponding holes 115 for receiving such pins and fixing the rotatable mixing head assembly to the boom of the excavating machinery.

In the preferred embodiment, the torque tube 100 holds and protects a group of lines 180 carrying hydraulic fluid and grease, for purposes described below. The torque tube 100 shown in FIG. 1 incorporates high pressure water nozzles 120 fed by water lines 130. A high-pressure spray of atomized water, without or without flocculants added, can thus be directed in the vicinity of the mixing area to suppress dust. The water lines 130 are brought to connections on the mounting assembly 110, so they may be connected to a remote water supply. The torque tube 100 and the mounting assembly 110 as shown in FIG. 1 also have attached a header 150 for delivering dry or liquid additives to the vicinity of the mixing area. The header 150 may be connected to a remote pump which will force the additive through the header 150 and into the mixing area.

The torque tube 100 of the preferred embodiment also has attached one or more implement attachment bars 140 for attaching pumps, shields, stabilizer bars, forced injection equipment, air scrubbers, or other tools required by the job.

FIG. 1 also shows the exterior of the rotatable mixing head 200. The mixing head is provided with a plurality of sockets 210 for connection with a corresponding plurality of mixing arms 220. In the preferred embodiment, the mixing arms 220 are removable to allow their replacement if they break or wear out in service, although in alternative embodiments, the mixing arms 220 could be welded or press fit to permanent attachment with the sockets 210. The mixing arms 220 may be attached to the sockets 210 by threaded collars, set screws, or by fasteners passing through the mixing arms 220 and sockets 210. The mixing arms 220 may be rigid or flexible. Rigid mixing arms 220 may be rods or tubes of diverse cross-sections, blades, or fluted castings. The shape of the mixing arms 220 may thus be adapted to the mixing task. Also, flexible mixing arms 220 may be used. Such flexible mixing arms 220 may be made of wire rope, rubber or plastic impregnated wire rope, or chain. Flexible mixing arms 220 are especially useful in applications where the rotatable mixing head assembly can be expected to encounter rocks or heavy junk which could break rigid mixing blades 220. In the preferred embodiment, the sockets 210 and the corresponding mixing arms 220 are disposed about the rotatable mixing head 200 in a helical line to provide more thorough mixing.

The rotatable mixing head 200 may have a means for attaching implements so that augers or cutting tools may be attached the rotatable mixing head 200. In the preferred embodiment, this means is an implement attachment plate 230. Instead of an attachment plate 230, the means for attaching implements may be a threaded or keyed shaft, or other conventional means for attaching tools. Where a containment pond has a liner, it will be desirable to attach a freely rotatable, relatively smooth, implement to the attachment plate 230, so the rotatable mixing head 200 will not injure the lining.

Figure 3:
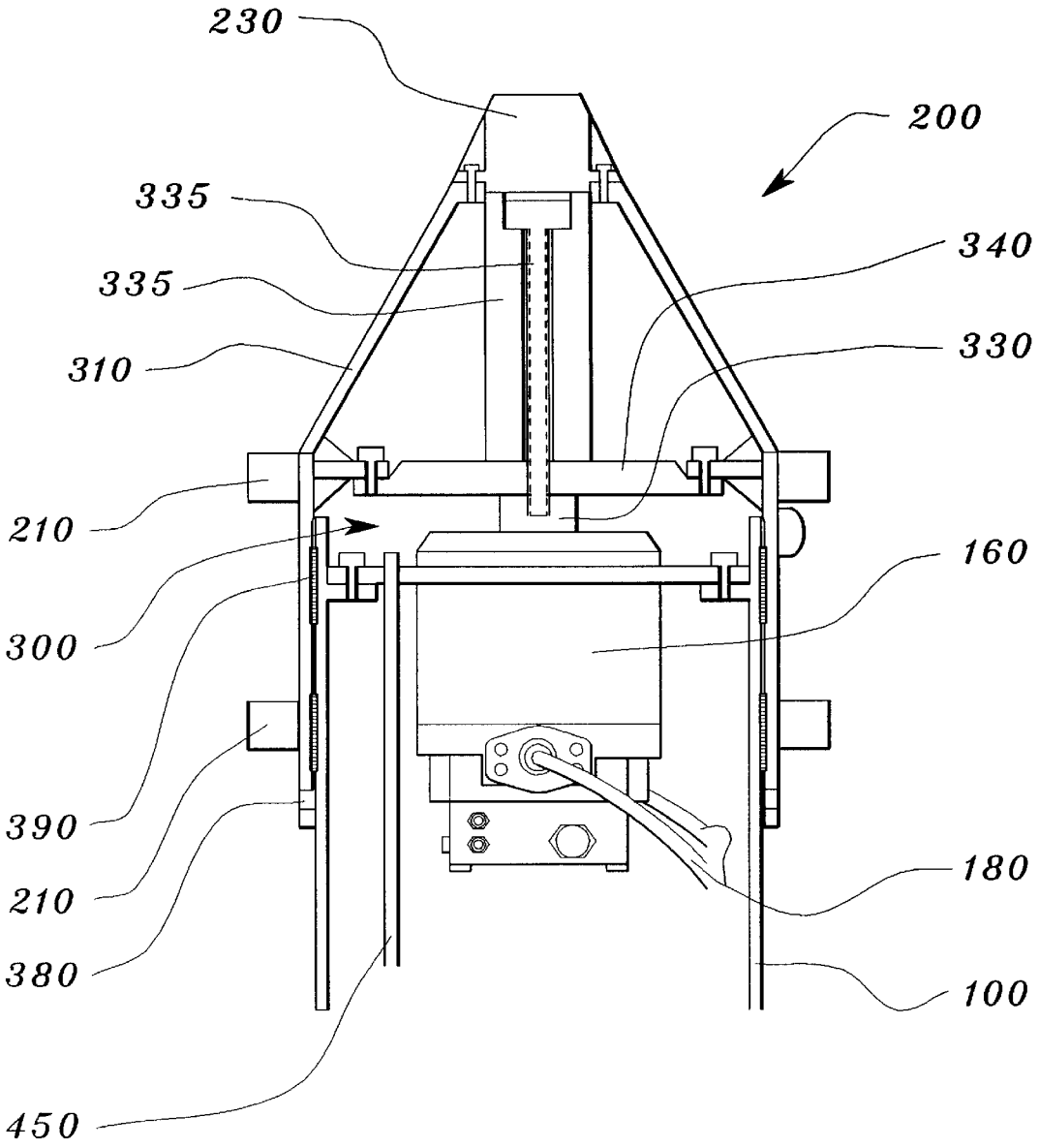
FIG. 3 shows a cut-away view of the rotatable mixing head assembly, showing the shaft, bearings, seals, and the means for circulating lubricants.
Figure 4:
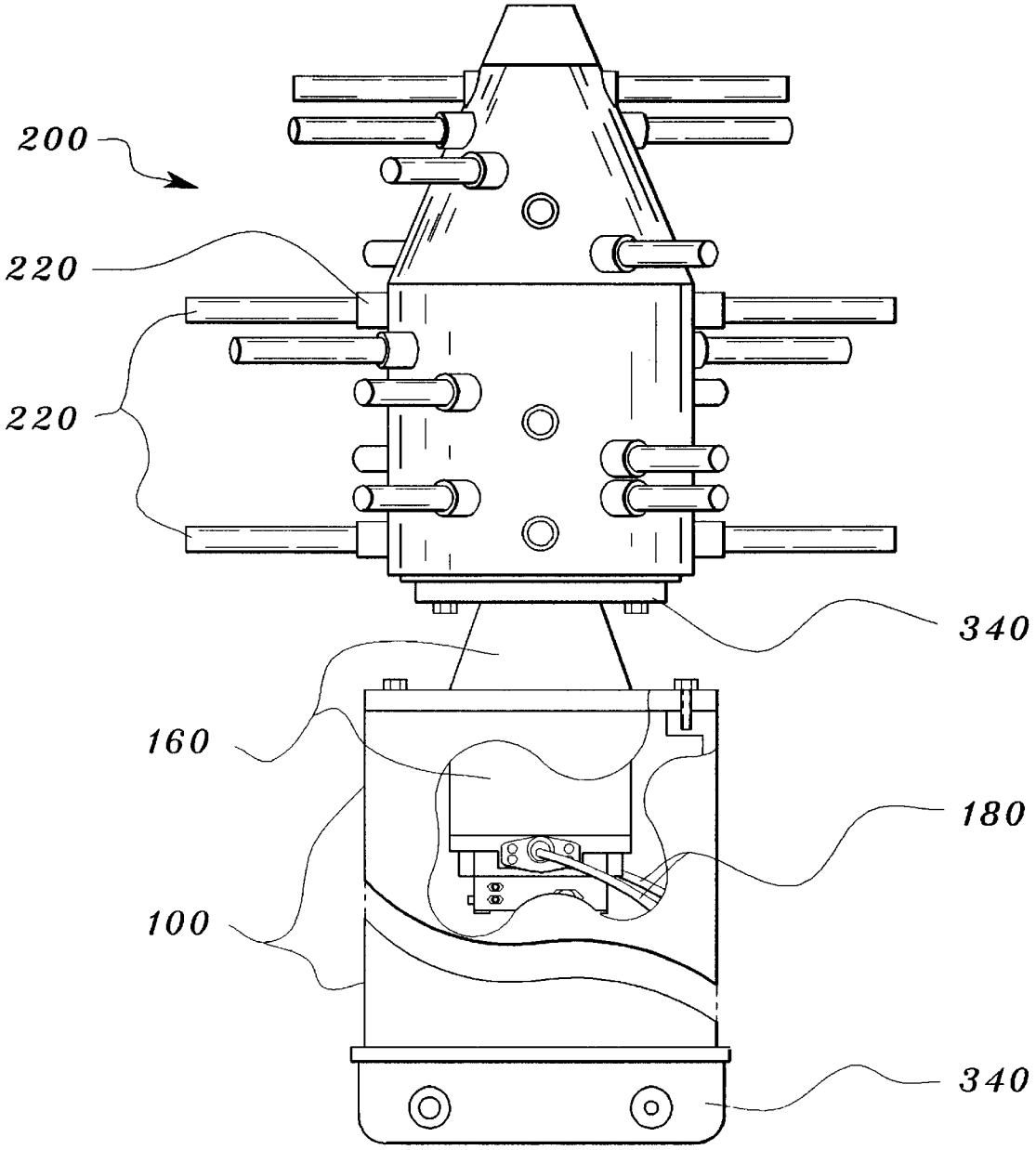
FIG. 4 shows a side view of an alternate embodiment of the rotatable mixing head assembly.

FIG. 3 show cut-away views of the rotatable mixing head 200. The rotatable mixing head 200 has two main sections; a casing 310, which is attached to the drive shaft 330, and rotatable with the drive shaft 330 about the torque tube 100, and a cavity 300 defined by the torque tube 100 and the casing 310. In the preferred embodiment a pilot shaft 335 extends from the drive shaft 330 to the casing 310 to stabilize the casing 310 as it rotates about the torque tube 100. Typical hydraulic motors, such as that illustrated in the preferred embodiment, have a drive shaft adapted to be connected to a hub. In the preferred embodiment, such a hub 340 is connected to the casing 310 as shown in FIG. 3, and thus cooperates in defining and enclosing the cavity 300. Other means of enclosing the cavity 300 could be used, such as a plate attached to the drive shaft 330 and the casing 310, by bolting or welding, so that the drive shaft 330 is effectively attached directly to the casing 310. Some hydraulic motors have a drive shaft integral with a hub, which hub is then flush with the motor face; an example of this type of motor is shown in FIG. 4. However, either type of motor may be used in either embodiment of the invention.

Since the sockets 210 for the mixing arms 220 and the attachment plate 230 are also attached to the casing 310, the mixing arms 220 and the attachment plate 230 rotate with the casing 310. In the preferred embodiment, rotatable mixing head 200 has the shape of a frustum of a cone, with the reduced end thereof most distant from the motor 160. This shape allows the operator to more easily shake off debris or untangle wire from the rotatable mixing head 200. A cone shape also requires less power to rotate because of its smaller surface area, is easier to force into a mix, and it tends to direct the flow of material upward, so that blending takes place.

The torque tube 100 and the casing 310 define a cavity 300. As the casing 310 rotates, it sealingly engages a cap 380 of rubber or other resilient material, as shown in FIG. 3. The torque tube 100 is provided with at least one wear ring 390. A means is provided for circulating a lubricant through the cavity 300. In the preferred embodiment, the lubricant flows through the cavity 300 through a line 450, past the wear rings 390, and exudes from the rotatable mixing head 200 where the casing 310 engages the cap 380. In the preferred embodiment, pressure for the lubricant flow is provided by remotely located grease pump. In this way, the surfaces of the casing 310 and the torque tube 100 are prevented from wearing directly against one another, and the positive flow of lubricant prevents abrasive particles and contaminants from entering the cavity 300 and harming the bearings exposed there. The wear rings 390 are preferably disposable and replaceable. The preferred lubricant is grease. However, in some applications, it will be important that a biodegradable lubricant be used. In this case, lard or another non-hydrocarbon lubricant, may be forced through the cavity 300. This arrangement protects the bearings and drive mechanisms of the rotatable mixing head 200 from corrosive and abrasive elements in the environment, while still allowing free rotation of the rotatable mixing head 200 in either sense.

FIG. 4 illustrates a second embodiment of the invention. In this case, the motor 160 has a hub 340 adapted for direct connection to the mixing head 200. The motor 160 (which may include a gear box) is mounted in the first end of the torque tube 100, but the casing 310 does not enclose the end of the torque tube 100 and the motor 160. This embodiment does not attempt to shield the motor and its bearings from contaminants and abrasives in the environment, and thus does not have the lubricant-filled cavity 300, enclosed torque tube 100, and wear rings 390 of the first embodiment.

The reader will see that the need for a mixing head having sufficient power to mix heavy material, easily moveable both laterally and vertically, resistant to tangling or impact with trash, and less likely to be worn out by contact with a hostile environment has been attained by the present invention, as described above. Since certain changes could be made in the embodiment of the invention described above without departing from the spirit and scope of the invention, we intend that all matter contained in the foregoing description and drawings shall be interpreted as illustrative and not in a limiting sense. The reader should understand that the following claims are intended to cover all of the generic and specific features of the invention herein described and all statements of the scope of the invention which might be interpreted to fall between these features.

We claim:

1. A rotatable mixing head assembly attachable to a boom of an excavating machine, the rotatable mixing head assembly comprising:

a. A torque tube having an axis, a first end and a second end, the torque tube further comprising:

i. A means for providing rotary power mounted within the torque tube adjacent to the first end of the torque tube; the means for providing rotary power axially aligned with the axis of the torque tube and having an output shaft; and, ii. A mounting assembly attached to the second end of the torque tube for removably attaching the rotatable mixing head assembly to the boom of an excavating machine;

b. a rotatable mixing head comprising:

i. A casing axially aligned with and enclosing the first end of the torque tube; the casing externally having a plurality of sockets for receiving a plurality of mixing arms;

ii. the output shaft of the means for providing rotary power connected to the casing, so that the casing rotates about the first end of the torque tube;

iii. the output shaft of the means for providing rotary power, the casing and the first end of the torque tube defining a cavity; and, iv. a means for sealing the cavity from the external environment.

2. The rotatable mixing head assembly of claim 1 where the means for providing rotary power further comprises a gear box for multiplying the torque of the means for providing rotary power.

3. The rotatable mixing head assembly of claim 1 where the means for providing rotary power comprises a hydraulic motor.

4. The rotatable mixing head assembly of claim 1 where the means for providing rotary power comprises an electric motor.

5. The rotatable mixing head assembly of claim 1 where the torque tube further comprises a header for delivering additives to the vicinity of the rotatable mixing head assembly.

6. The rotatable mixing head assembly of claim 1 where the torque tube further comprises a means for spraying water in the vicinity of the rotatable mixing head assembly for controlling dust.

7. The rotatable mixing head assembly of claim 1 where the means for sealing the cavity from the external environment comprises a resilient cap attached to the first end of the torque tube and sealingly engaging the casing.

8. The rotatable mixing head assembly of claim 7 where the means for sealing the cavity further comprises a means for delivering lubricant under pressure to the cavity defined by the casing, the first end of the torque tube, and the output shaft of the means for providing rotary power, thereby causing the lubricant to be extruded from the cavity where the casing engages the resilient cap.

9. The rotatable mixing head assembly of claim 1 where the rotatable mixing head further comprises at least one wear ring mounted co-axially between the first end of the torque tube and the casing.

10. A rotatable mixing head assembly attachable to a boom of an excavating machine, the rotatable mixing head assembly comprising:

a. A torque tube having an axis, a first end and a second end, the torque tube further comprising:

i. A means for providing rotary power mounted within the torque tube adjacent to the first end of the torque tube; the means for providing rotary power axially aligned with the axis of the torque tube and having an output shaft;

ii. A mounting assembly attached to the second end of the torque tube for removably attaching the rotatable mixing head assembly to the boom of an excavating machine;

b. a rotatable mixing head comprising:

i. A casing axially aligned with the first end of the torque tube; the casing externally having a plurality of sockets for receiving a plurality of mixing arms;

ii. the output shaft of the means for providing rotary power connected to the casing, so that the casing rotates with respect to the torque tube.

11. The rotatable mixing head assembly of claim 10 where the means for providing rotary power further comprises a gear box for multiplying the torque of the means for providing rotary power.

12. The rotatable mixing head assembly of claim 10 where the means for providing rotary power comprises a hydraulic motor.

13. The rotatable mixing head assembly of claim 10 where the means for providing rotary power comprises an electric motor.

14. The rotatable mixing head assembly of claim 10 where the torque tube further comprises a header for delivering additives to the vicinity of the rotatable mixing head assembly.

15. The rotatable mixing head assembly of claim 10 where the torque tube further comprises a means for spraying water in the vicinity of the rotatable mixing head assembly for controlling dust.

16. The rotatable mixing head assembly of claim 1 or claim 10 where the rotatable mixing head assembly has a plurality of mixing arms attached to the sockets.

17. The rotatable mixing head assembly of claim 16 where the mixing arms are rigid.

18. The rotatable mixing head assembly of claim 16 where the mixing arms are flexible.

19. The rotatable mixing head assembly of claim 1 or claim 10 where the rotatable mixing head assembly further comprises a means for attaching an implement to the rotatable mixing head.

20. A rotatable mixing head assembly attachable to a boom of an excavating machine, the rotatable mixing head assembly comprising:

a. A torque tube having an axis, a first end and a second end, the torque tube further comprising:

i. a hydraulic motor mounted within the torque tube adjacent to the first end of the torque tube; the hydraulic motor connected to a gear box; the gear box having an output shaft; the hydraulic motor and gear box axially aligned with the axis of the torque tube;

ii. A mounting assembly attached to the second end of the torque tube for removably attaching the rotatable mixing head assembly to the boom of an excavating machine; and, iii. a plurality of implement attachment points connected to the torque tube;

b. a rotatable mixing head assembly comprising:

i. A casing axially aligned with and enclosing the first end of the torque tube; the casing externally having a plurality of sockets for receiving a plurality of mixing arms;

ii. the output shaft of the gear box connected to the casing, so that the casing rotates about the first end of the torque tube;

iii. the output shaft of the gear box, the casing and the first end of the torque tube defining a cavity; and, iv. means for sealing the cavity from the external environment; the sealing means further comprising:

(1) a resilient cap attached to the first end of the torque tube and sealingly engaging the casing;

(2) a means for delivering lubricant under pressure to the cavity defined by the casing, thereby causing the lubricant to be extruded from the cavity where the casing engages the resilient cap; and, v. at least one wear ring mounted co-axially between the first end of the torque tube and the casing;

c. a plurality of mixing arms removably attached to the sockets; the sockets and the mixing arms disposed about the rotatable mixing head assembly in at least one helical row; and, d. a means for attaching an implement to the rotatable mixing head assembly.

21. A rotatable mixing head assembly attachable to a boom of an excavating machine, the rotatable mixing head assembly comprising:

a. A torque tube having an axis, a first end and a second end, the torque tube further comprising:

i. a hydraulic motor having an output shaft mounted within the torque tube adjacent to the first end of the torque tube; the hydraulic motor axially aligned with the axis of the torque tube;

ii. A mounting assembly attached to the second end of the torque tube for removably attaching the rotatable mixing head assembly to the boom of an excavating machine; and, iii. a plurality of implement attachment points connected to the torque tube;

b. a rotatable mixing head comprising:

i. A casing axially aligned with and enclosing the first end of the torque tube; the casing externally having a plurality of sockets for receiving a plurality of mixing arms;

ii. the output shaft of the hydraulic motor connected to the casing, so that the casing rotates about the first end of the torque tube;

iii. the output shaft of the hydraulic motor, the casing and the first end of the torque tube defining a cavity; and, iv. means for sealing the cavity from the external environment; the sealing means further comprising:

(1) a resilient cap attached to the first end of the torque tube and sealingly engaging the casing;

(2) a means for delivering lubricant under pressure to the cavity defined by the casing, thereby causing the lubricant to be extruded from the cavity where the casing engages the resilient cap; and, v. at least one wear ring mounted co-axially between the first end of the torque tube and the casing;

c. a plurality of mixing arms removably attached to the sockets; the sockets and the mixing arms disposed about the rotatable mixing head in at least one helical row; and, d. a means for attaching an implement to the rotatable mixing head assembly.

* * * * *